US011279009B2

(12) United States Patent
Chiang

(10) Patent No.: US 11,279,009 B2
(45) Date of Patent: Mar. 22, 2022

(54) TORQUE WRENCH

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 62 days.

(21) Appl. No.: 16/850,449

(22) Filed: Apr. 16, 2020

(65) Prior Publication Data

US 2020/0398410 A1 Dec. 24, 2020

(30) Foreign Application Priority Data

Jun. 21, 2019 (TW) ..... 108121682

(51) Int. Cl.
*B25B 23/142* (2006.01)
*B25B 23/14* (2006.01)

(52) U.S. Cl.
CPC ..... *B25B 23/1427* (2013.01); *B25B 23/141* (2013.01)

(58) Field of Classification Search
CPC . B25B 23/1427; B25B 23/1425; B25B 23/14; B25B 23/1422; B25B 23/141
USPC ..... 81/478, 479, 467, 475, 474, 476
See application file for complete search history.

(56) References Cited

U.S. PATENT DOCUMENTS 3,847,038 A * 11/1974 Green ..... B25B 23/1427 81/477
4,290,329 A * 9/1981 Green ..... B25B 23/1427 81/477
6,722,235 B2 * 4/2004 Hsieh ..... B25B 23/1427 81/478
2007/0227316 A1 * 10/2007 Lucke ..... B25B 23/1427 81/478
2011/0023576 A1 * 2/2011 Mountz ..... B25B 23/1427 73/1.12
2015/0328756 A1 * 11/2015 Ho ..... B25B 23/1425 81/479
2018/0099386 A1 * 4/2018 Reeder ..... B25B 23/141

* cited by examiner

*Primary Examiner* — Joseph J Hail
*Assistant Examiner* — Robert C Moore
(74) *Attorney, Agent, or Firm* — Muncy, Geissler, Olds & Lowe, P.C.

(57) ABSTRACT

A torque wrench includes a main body, a driving portion, a torque-disengageable mechanism, a torque assembly and an adjusting assembly. The main body defines an axial direction and includes a handle and a tubular member which are assembled with each other. The handle has an opening which is open radially. The torque-disengageable mechanism is swingably disposed within the tubular member. The torque assembly is disposed in the main body. The adjusting assembly includes a position-limiting member, a slidable assembly and an adjusting member. The adjusting member is rotatably connected to the handle and corresponding to the opening. The adjusting member has a first threaded portion. The slidable assembly has a second threaded portion screwed with the first threaded portion.

8 Claims, 7 Drawing Sheets

TORQUE WRENCH

BACKGROUND OF THE INVENTION

Field of the Invention

The present invention relates to a torque wrench.

Description of the Prior Art

A torque wrench capable of adjusting torque setting value is usually used in fastening or unfastening fasteners, which can avoid problems such as damage to the object or the fastener due to over-tightening. A working portion is provided at one end of a main body of the torque wrench, a torque adjusting shaft is provided in the main body to adjust the torque setting value, a rotatable adjusting member is installed at the other end of the main body, and the adjusting button is screwed with the torque adjusting shaft. When turning the rotatable adjusting member, the torque adjustment shaft is driven by the rotatable adjusting member to move axially, thereby adjusting the torque setting value.

However, since the rotatable adjusting member of the conventional torque wrench is provided at one end of the main body opposite to the working portion, when adjustment of the torque setting value is required, the main body needs to be held in one hand and the rotatable adjusting member needs to be turned by another hand, and thus it is convenient in use.

The present invention is, therefore, arisen to obviate or at least mitigate the above-mentioned disadvantages.

SUMMARY OF THE INVENTION

The main object of the present invention is to provide a torque wrench, wherein the torque setting value can be adjusted by one single hand.

To achieve the above and other objects, a torque wrench is provided, including: a main body, defining an axial direction, including a handle and a tubular member which are assembled with each other, the handle including an opening which is open radially; a driving portion, including a rod member and swingably disposed within the tubular member; a torque-disengageable mechanism, swingably disposed within the tubular member and abutted against the rod member; a torque assembly, disposed in the main body, including an elastic member and an abutting member, the abutting member being fixed with the elastic member and abutted against the torque-disengageable mechanism; an adjusting assembly, including a position-limiting member, a slidable assembly and an adjusting member, the adjusting member being rotatably connected to the handle and corresponding to the opening, the slidable assembly being fixed with the position-limiting member, disposed in the main body and slidable along the axial direction, the position-limiting member being abutted against the elastic member, the adjusting member including a first threaded portion, the slidable assembly including a second threaded portion screwed with the first threaded portion, the adjusting member being rotatable to drive the position-limiting member and the slidable assembly to move along the axial direction to adjust abutment position of the position-limiting member and the elastic member; wherein the position-limiting member serves as a fulcrum so that a deformable portion is defined on the elastic member between the position-limiting member and the abutting member, when a force exerted on the driving portion is equal to or greater than a force value of the deformable portion, the torque-disengageable mechanism and the abutting member are disengaged from each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
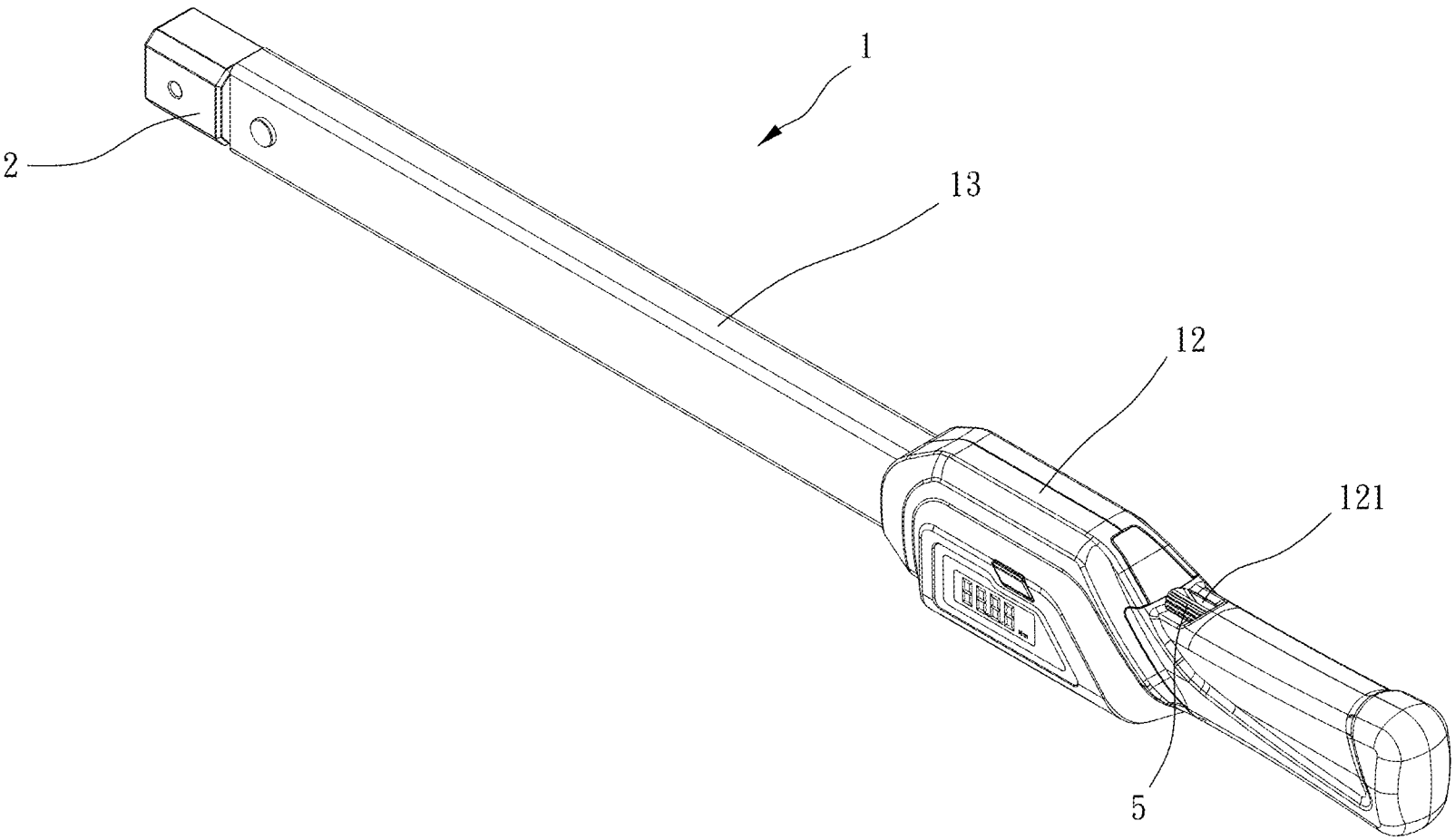
FIG. 1 is a stereogram of a preferable embodiment of the present invention.
Figure 2:
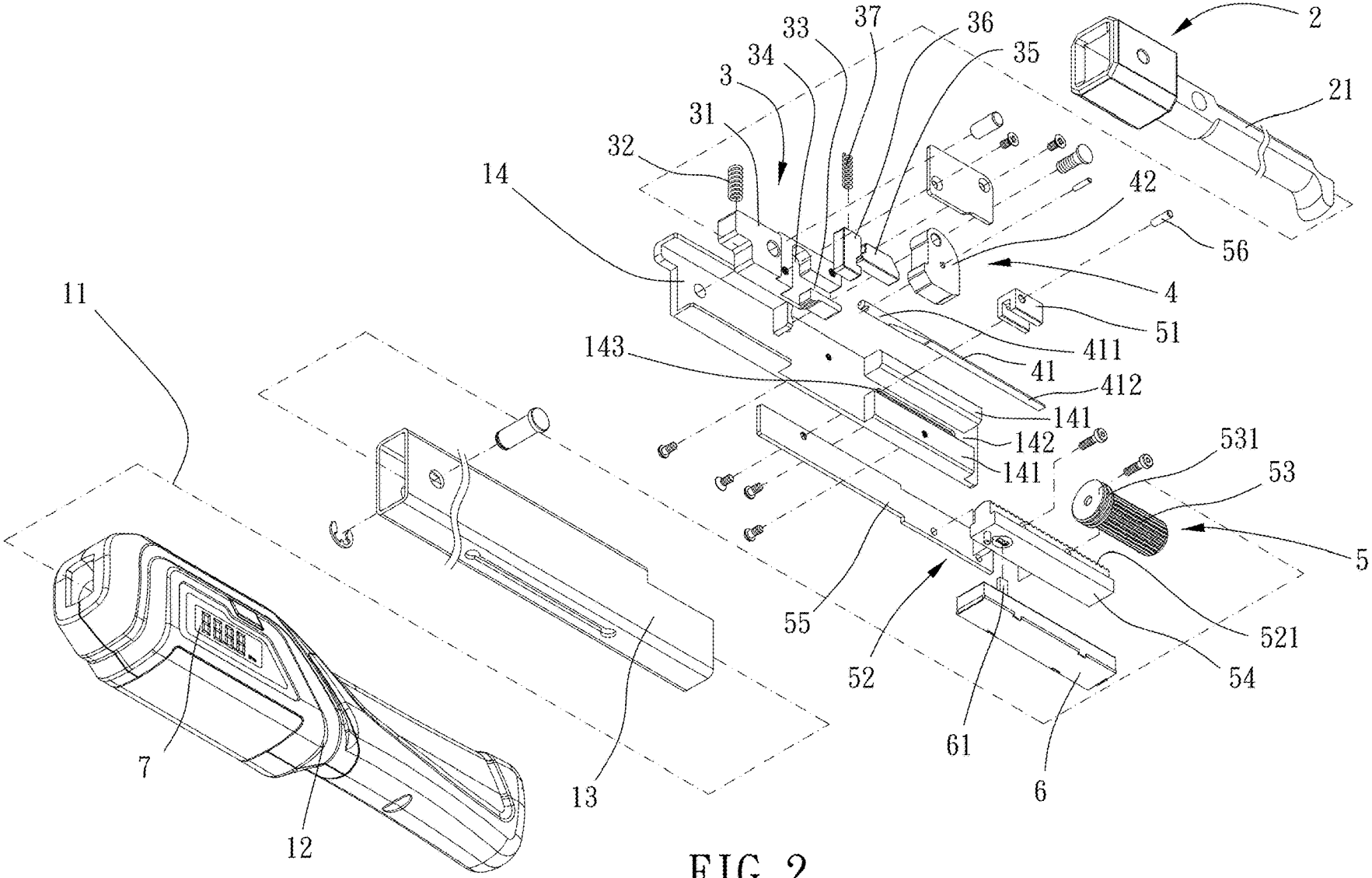
FIGS. 2 and 3 are breakdown drawings of a preferable embodiment of the present invention.
Figure 3:
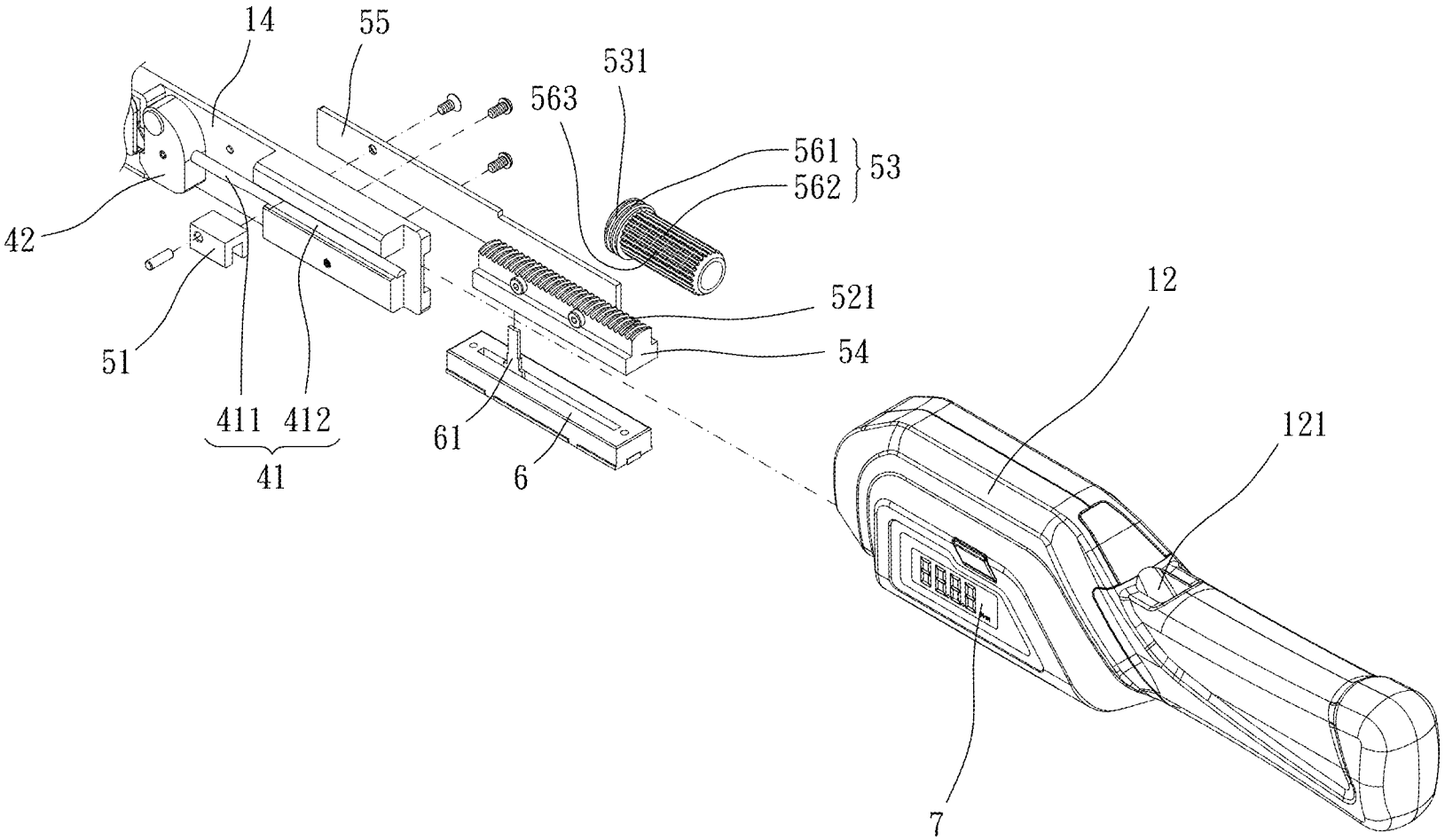
Figure 4:
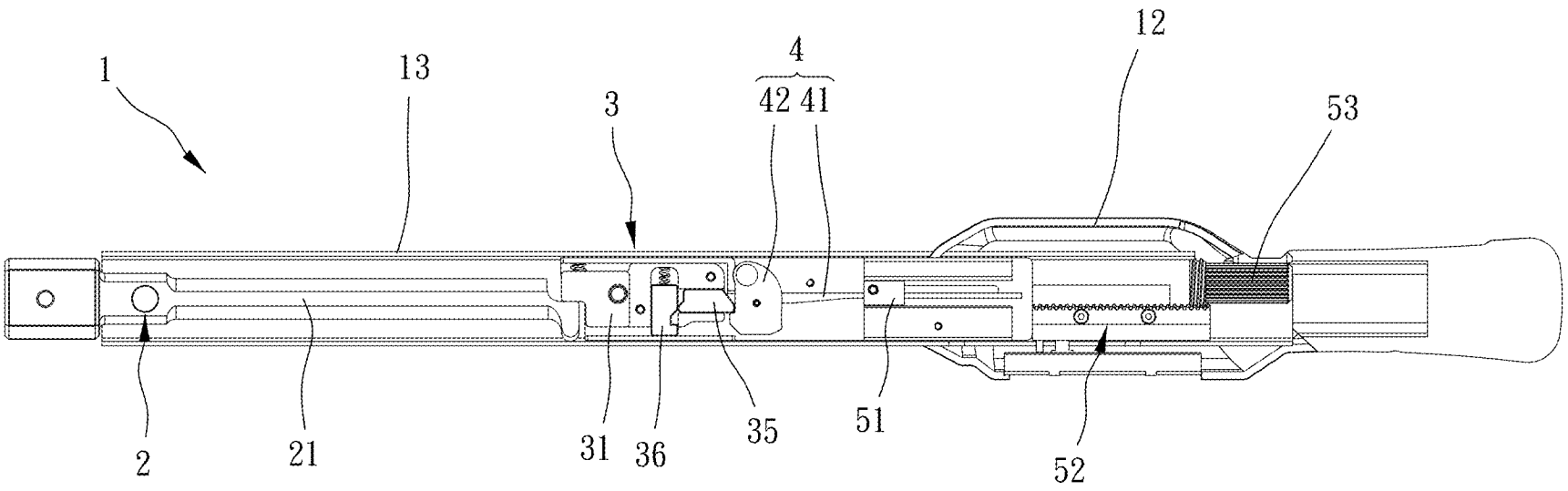
FIG. 4 is a side cross-sectional view of a preferable embodiment of the present invention.
Figure 5:
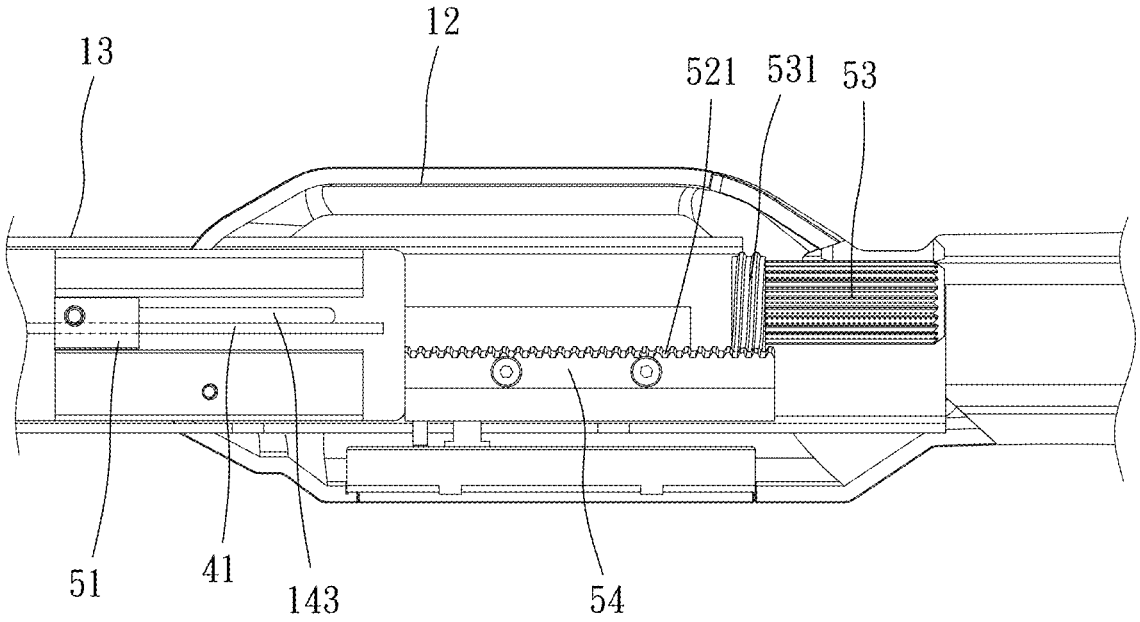
FIGS. 5 and 6 are drawings showing action of an adjusting assembly of a preferable embodiment of the present invention.
Figure 6:
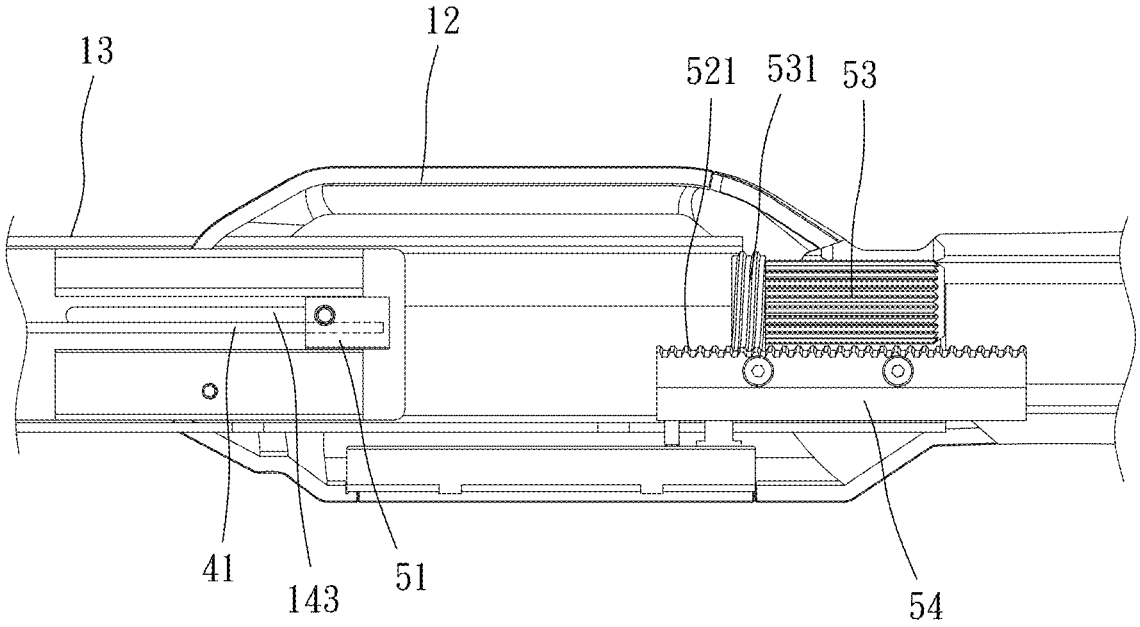
Figure 7:
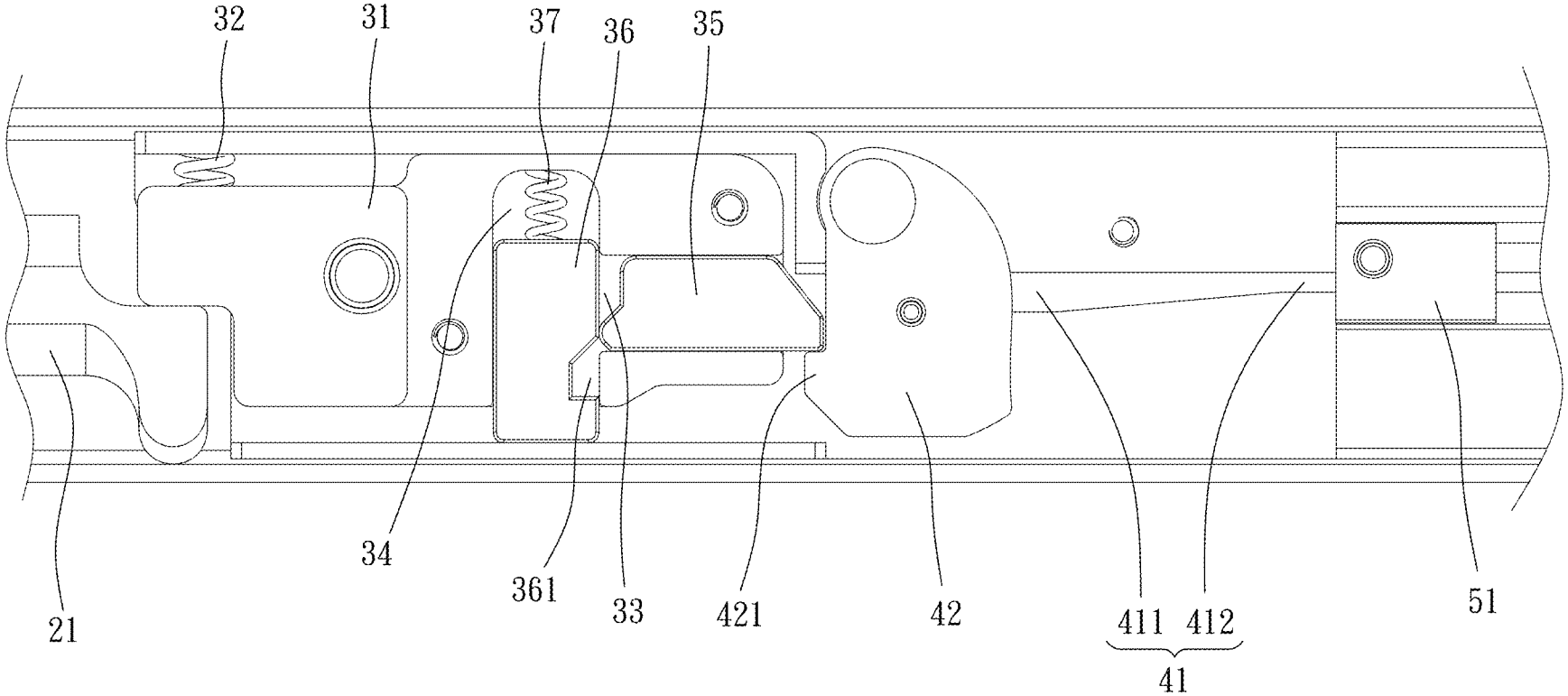
FIGS. 7 and 8 are drawings showing action of a torque-disengageable mechanism of a preferable embodiment of the present invention.
Figure 8:
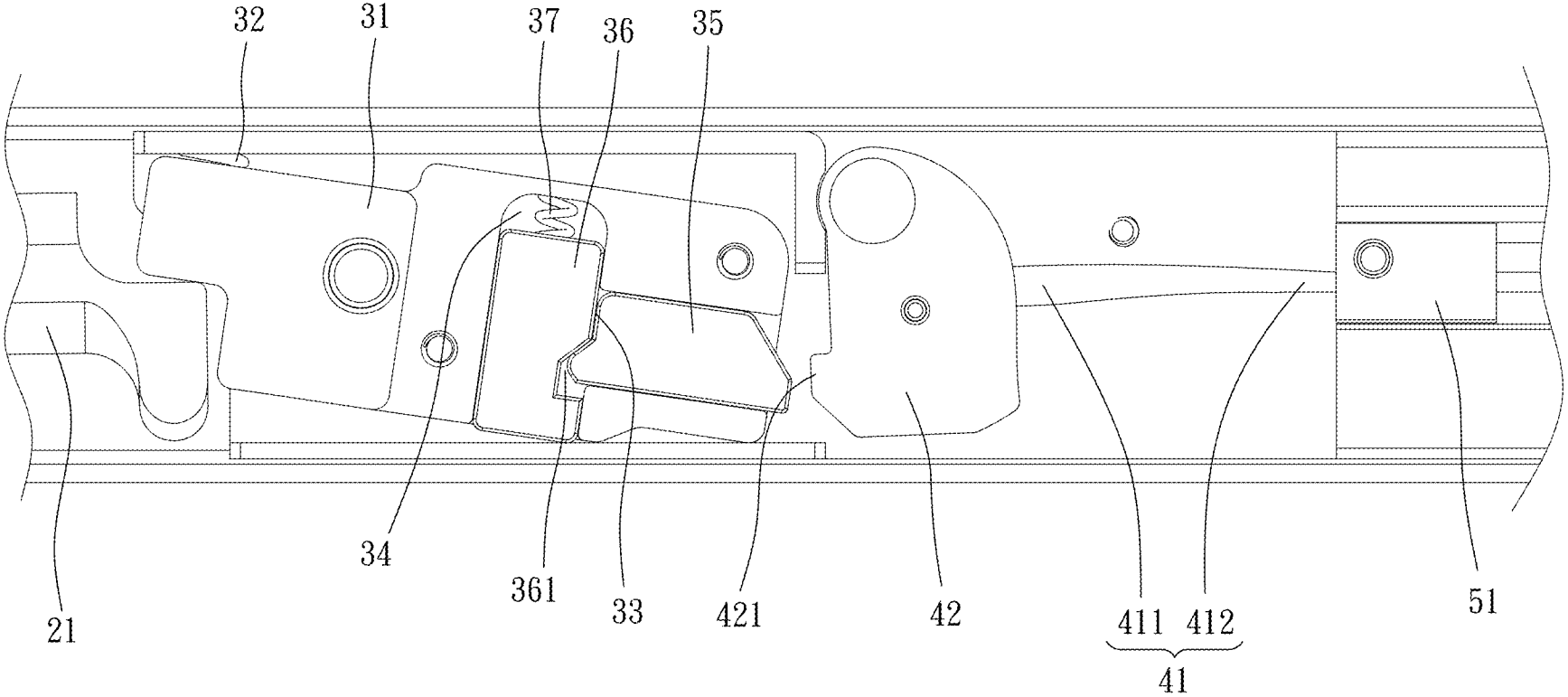

Please refer to FIGS. 1 to 8 for a preferable embodiment of the present invention. A torque wrench 1 of the present invention includes a main body 1, a driving portion 2, a torque-disengageable mechanism 3, a torque assembly 4 and an adjusting assembly 5.

The main body 1 defines an axial direction 11 and includes a handle 12 and a tubular member 13 which are assembled with each other, and the handle 12 includes an opening 121 which is open radially.

The driving portion 2 includes a rod member 21 and is swingably disposed within the tubular member 13. In this embodiment, the driving portion 2 includes an assembling portion for connection of a tool such as socket, polygonal tool bit or the like.

The torque-disengageable mechanism 3 is swingably disposed within the tubular member 13 and abutted against the rod member 21.

The torque assembly 4 is disposed in the main body 1 and includes an elastic member 41 and an abutting member 42. The abutting member 42 is fixed with the elastic member 41 and abutted against the torque-disengageable mechanism 3.

The adjusting assembly 5 includes a position-limiting member 51, a slidable assembly 52 and an adjusting member 53. The adjusting member 53 is rotatably connected to the handle 12 and corresponds to the opening 121. The slidable assembly 52 is fixed with the position-limiting member 51, disposed in the main body 1 and slidable along the axial direction 11. The position-limiting member 51 is abutted against the elastic member 41, the adjusting member 53 includes a first threaded portion 531, and the slidable assembly 52 includes a second threaded portion 521 screwed with the first threaded portion 531. The adjusting member 53 is rotatable to drive the position-limiting member 51 and the slidable assembly 52 to move along the axial direction 11 to adjust the relative abutment position of the position-limiting member 51 and the elastic member 41.

The position-limiting member 51 serves as a fulcrum so that a deformable portion is defined on the elastic member 41 between the position-limiting member 51 and the abutting member 42. By changing the relative abutment position of the position-limiting member 51 and the elastic member 41, the torque setting value of the torque wrench can be set, accordingly. When a force exerted on the driving portion 2 is equal to or greater than a force value of the deformable portion, the torque-disengageable mechanism 3 and the abutting member 42 are disengaged from each other, thus avoiding over large force. Since the adjusting member 53 corresponds to the opening 121, the adjusting member 53 can be turned with one single hand gripping on the handle 12, so as to adjust the slidable assembly 52 and the position-limiting member 51 to move along the axial direction 11 for adjusting the force value of the deformable portion the deformable portion, which is convenient in use and adjustment.

Specifically, the tubular member 13 includes a base 14 thereinside, the base 14 includes two guiding blocks 141, and the two guiding blocks 141 define a first guiding groove 142 therebetween. The position-limiting member 51 is slidably disposed within the first guiding groove 142 and sleeved on the elastic member 41, which prevents lateral movement of the position-limiting member 51 relative to the axial direction 11.

The slidable assembly 52 includes a slidable member 54 and a connection member 55. The slidable member 54 includes the second threaded portion 521, and the connection member 55 is connected between the position-limiting member 51 and the slidable member 54. The base 14 further includes a slit 143, and the slit 143 is parallel to and corresponds to the first guiding groove 142. The connection member 55 and the position-limiting member 51 are located by two sides of the base 14 and connected with each other by a fastener 56 disposed through the slit 143 so that the position-limiting member 51, the slidable member 54 and the connection member 55 are movable all together.

The torque wrench further includes a detecting module 6 and a display module 7 which are disposed on the handle 12. The detecting module 6 includes a detecting member 61 which is movable together with the slidable member 54, the detecting module 6 obtains and sends detecting data of position of the detecting member 61 relative to the detecting module 6 to the display module 7 for displaying of a torque setting value (required torque setting value) associated with the detecting data on the display module 7.

In this embodiment, the adjusting member 53 includes a large diameter section 561 and a small diameter section 562. A circumferential surface of the small diameter section 562 includes a plurality of splines 563 extending along the axial direction 11, and the small diameter section 562 corresponds to the opening 121. The plurality of splines 563 provides effective operation of the small diameter section 562 for turning the adjusting member 53 easily. A circumferential surface of the large diameter section 561 includes the first threaded portion 531. The slidable member 54 has a cross-section which is T-shaped so that the slidable member 54 is non-rotatably and slidably assembled to the main body 1. The slidable member 54 includes the second threaded portion 521 facing toward the adjusting member 53.

Preferably, the torque-disengageable mechanism 3 includes a swingable member 31, and the swingable member 31 is rotatably connected to the tubular member 13 and swingable between a first position and a second position. A first recovery spring 32 is disposed between the tubular member 13 and the swingable member 31 and biases the swingable member 31 toward the first position to abut against the abutting member 42. In this embodiment, the first recovery spring 32 biases an end of the swingable member 31 near the rod member 21 in a direction lateral to the axial direction 11. When the driving portion 2 is forced, the rod member 21 urges the swingable member 31 toward the second position, and when the swingable member 31 applies a force equal to or greater than the force value of the deformable portion, the abutting member 42 moves toward the elastic member 41 and the swingable member 31 moves to the second position so that the swingable member 31 and the abutting member 42 are disengaged from each other. Specifically, the abutting member 42 is rotatably connected to the tubular member 13, and the elastic member 41 biases the abutting member 42 toward the swingable member 31. The abutting member 42 includes a projection 421. When the swingable member 31 is in the first position, the swingable member 31 is engaged with the projection 421.

The swingable member 31 includes a second guiding groove 33 extending along a longitudinal direction of the swingable member 31 and a third guiding groove 34 lateral to and communicated with the second guiding groove 33. A second slidable block 35 is slidably disposed within the second guiding groove 33, and a third slidable block 36 is slidably disposed within the third guiding groove 34. The third slidable block 36 includes a recess 361. A second recovery spring 37 is disposed between the third guiding groove 34 and the third slidable block 36 and biases the third slidable block 36 outwardly with respect to the third guiding groove 34. When the swingable member 31 is in the first position, the recess 361 of the third slidable block 36 does not correspond to the second slidable block 35 and the second slidable block 35 is engaged with the projection 421; when the swingable member 31 is in the second position, the third slidable block 36 is abutted against the tubular member 13 and moves toward a bottom of the third guiding groove 34, and the recess 361 corresponds to the second slidable block 35 and the second slidable block 35 is movable toward the recess 361 so that the second slidable block 35 and the abutting member 42 are disengaged from each other. The second slidable block 35, third slidable block 36, second guiding groove 33 and third guiding groove 34 are taken as an example for the torque-disengageable mechanism 3 of the present invention, but are not limited thereto.

In this embodiment, the position-limiting member 51 is a U-shaped member. The elastic member 41 includes a circular section 411 and a semi-circular section 412 which are integrally connected with each other. The circular section 411 is connected with the abutting member 42, the semi-circular section 412 is disposed within the first guiding groove 142, a plane of the semi-circular section 412 and the projection 421 of the abutting member 42 correspond to a same side of the tubular member, and the position-limiting member 51 is saddled and abutted on an arced surface of the semi-circular section 412, which provides the fulcrum and the deformable portion between the position-limiting member 51 and the abutting member 42.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque wrench, including:

a main body, defining an axial direction, including a handle and a tubular member which are assembled with each other, the handle including an opening which is open radially;

a driving portion, including a rod member and swingably disposed within the tubular member;

a torque-disengageable mechanism, swingably disposed within the tubular member and abutted against the rod member;

a torque assembly, disposed in the main body, including an elastic member and an abutting member, the abutting member being fixed with the elastic member and abutted against the torque-disengageable mechanism;

an adjusting assembly, including a position-limiting member, a slidable assembly and an adjusting member, the adjusting member being rotatably connected to the handle and corresponding to the opening, the slidable assembly being fixed with the position-limiting member, disposed in the main body and slidable along the axial direction, the position-limiting member being abutted against the elastic member, the adjusting member including a first threaded portion, the slidable assembly including a second threaded portion screwed with the first threaded portion, the adjusting member being rotatable to drive the position-limiting member and the slidable assembly to move along the axial direction to adjust abutment position of the position-limiting member and the elastic member;

wherein the position-limiting member serves as a fulcrum so that a deformable portion is defined on the elastic member between the position-limiting member and the abutting member, when a force exerted on the driving portion is equal to or greater than a force value of the deformable portion, the torque-disengageable mechanism and the abutting member are disengaged from each other, wherein the tubular member includes a base thereinside, the base includes two guiding blocks, the two guiding blocks define a first guiding groove therebetween, and the position-limiting member is slidably disposed within the first guiding groove and sleeved on the elastic member.

2. The torque wrench of claim 1, wherein the slidable assembly further includes a slidable member and a connection member, the slidable member includes the second threaded portion, the connection member is connected between the position-limiting member and the slidable member, the base further includes a slit, the slit is parallel to and corresponds to the first guiding groove, the connection member and the position-limiting member are located by two sides of the base and connected with each other by a fastener disposed through the slit.

3. The torque wrench of claim 2, further including a detecting module and a display module which are disposed on the handle, the detecting module including a detecting member which is movable together with the slidable member, the detecting module obtaining and sending detecting data of position of the detecting member relative to the detecting module to the display module for displaying of a torque setting value associated with the detecting data on the display module.

4. The torque wrench of claim 2, wherein the adjusting member includes a large diameter section and a small diameter section, a circumferential surface of the small diameter section includes a plurality of splines extending in the axial direction, the small diameter section corresponds to the opening, a circumferential surface of the large diameter section includes the first threaded portion, the slidable member has a cross-section which is T-shaped, and the slidable member includes the second threaded portion facing toward the adjusting member.

5. The torque wrench of claim 1, wherein the torque-disengageable mechanism includes a swingable member, the swingable member is rotatably connected to the tubular member and swingable between a first position and a second position, a first recovery spring is disposed between the tubular member and the swingable member and biases the swingable member toward the first position to abut against the abutting member, when the driving portion is forced, the rod member urges the swingable member toward the second position, and when the swingable member applies a force equal to or greater than the force value of the deformable portion, the abutting member moves toward the elastic member and the swingable member moves to the second position so that the swingable member and the abutting member are disengaged from each other.

6. The torque wrench of claim 5, wherein the abutting member is rotatably connected to the tubular member, the elastic member biases the abutting member toward the swingable member, the abutting member includes a projection, and when the swingable member is in the first position, the swingable member is engaged with the projection.

7. The torque wrench of claim 6, wherein the swingable member includes a second guiding groove extending along a longitudinal direction of the swingable member and a third guiding groove lateral to and communicated with the second guiding groove, a second slidable block is slidably disposed within the second guiding groove, a third slidable block is slidably disposed within the third guiding groove, the third slidable block includes a recess, a second recovery spring is disposed between the third guiding groove and the third slidable block and biases the third slidable block outwardly with respect to the third guiding groove, when the swingable member is in the first position, the recess of the third slidable block does not correspond to the second slidable block and the second slidable block is engaged with the projection, when the swingable member is in the second position, the third slidable block is abutted against the tubular member and moves toward a bottom of the third guiding groove, and the recess corresponds to the second slidable block and the second slidable block is movable toward the recess so that the second slidable block and the abutting member are disengaged from each other.

8. The torque wrench of claim 6, wherein the position-limiting member is a U-shaped member, the elastic member includes a circular section and a semi-circular section which are integrally connected with each other, the circular section is connected with the abutting member, the semi-circular section is disposed within the first guiding groove, a plane of the semi-circular section and the projection of the abutting member correspond to a same side of the tubular member, and the position-limiting member is saddled and abutted on an arced surface of the semi-circular section.

* * * * *